United States Patent [19]

Thornton

[11] 3,958,802

[45] May 25, 1976

[54] JUMPING HOOP

[76] Inventor: Ernest R. Thornton, Rte. 2, Box 228-C, Point Pleasant, W. Va. 25550

[22] Filed: June 14, 1974

[21] Appl. No.: 479,406

Related U.S. Application Data

[63] Continuation of Ser. No. 262,936, June 15, 1972, abandoned.

[52] U.S. Cl. ..... 272/74; 285/260; 285/305; 403/313

[51] Int. Cl.[2] ..... A63B 5/22

[58] Field of Search ..... 272/74; 285/260, 305, 285/423, 238; 403/300, 302, 309, 313, 314

[56] References Cited

UNITED STATES PATENTS

| | | | |
|---|---|---|---|
| 3,072,402 | 1/1963 | McCombs | 272/74 |
| 3,466,032 | 9/1969 | Thornton | 272/74 |
| 3,534,988 | 10/1970 | Lindsey | 285/305 |
| 3,606,402 | 9/1971 | Medney | 285/305 |

FOREIGN PATENTS OR APPLICATIONS

| | | | |
|---|---|---|---|
| 892,351 | 3/1962 | United Kingdom | 285/238 |
| 314,867 | 9/1969 | Sweden | 285/305 |
| 1,359,919 | 3/1964 | France | 285/260 |

*Primary Examiner*—Richard C. Pinkham
*Assistant Examiner*—Richard T. Stouffer
*Attorney, Agent, or Firm*—James C. Wray

[57] ABSTRACT

A jumping hoop has a rigid U-shaped member which is held in the hand. A light flexible member is adjustably connected to opposite ends of the rigid member, forming a hoop. Ends of the rigid members are reentrantly bent to hold ends of the flexible member telescoped therewith. Ends are held together by an elastic band which jams between the sliding telescoping members in one construction.

5 Claims, 5 Drawing Figures

FIG. 1
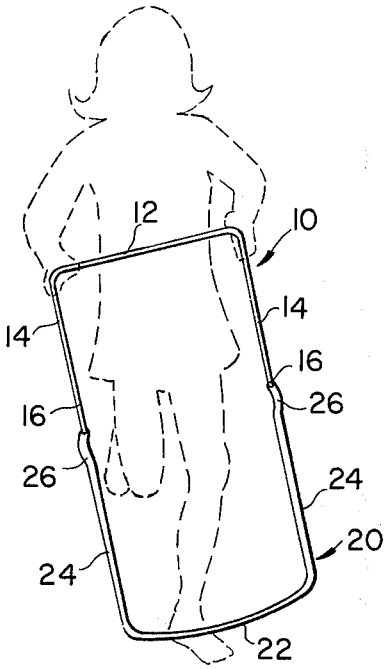
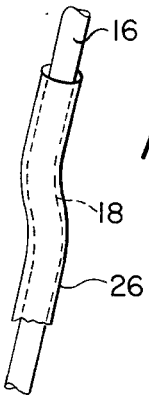
FIG. 1A
FIG. 2
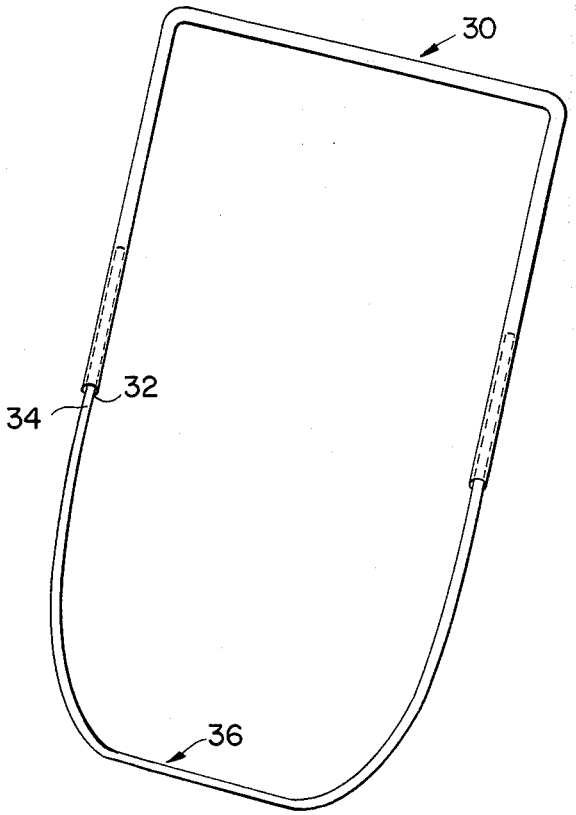
FIG. 3
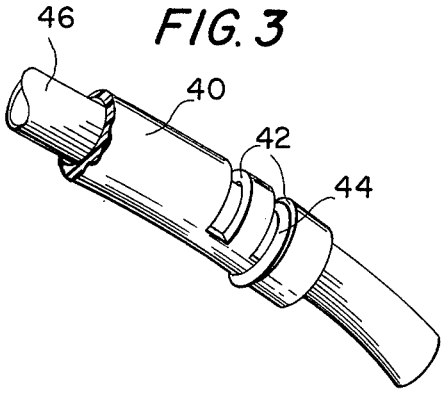
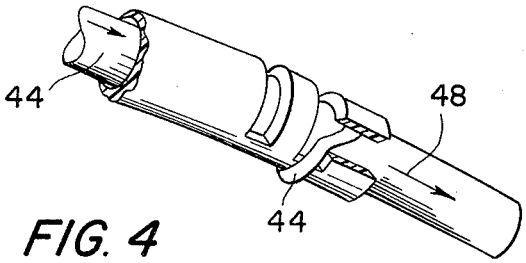
FIG. 4

JUMPING HOOP

This is a continuation of copending application Ser. No. 262,936, filed June 15, 1972 by Ernest R. Thornton for a Jumping Hoop and now abandoned.

BACKGROUND OF THE INVENTION

Jumping hoops are popular devices. To obtain maximum use and fun from a jumping hoop, it is desirable that a hoop be adjustable in size, so that it may be used by short or tall individuals and so that its dimensions may be varied to provide different degrees of difficulty in use of the hoop.

It is desirable that the adjustment in hoop size be accomplished quickly without requirement for tools.

One form of adjustable jumping hoop is described in U.S. Pat. No. 3,466,032, entitled adjustable size jumping hoop, which was issued on Sept. 9, 1969 to Ernest R. Thornton of Point Pleasant, West Virginia.

SUMMARY OF THE INVENTION

The present invention provides an adjustable jumping hoop which is constructed of a rigid, handheld, U-shaped section and a soft outer section, which causes no discomfort upon contact with the body. The rigid, hand-held member holds the soft outer member in U-shaped form. Ends of one member are slidable upon ends of the other member to interconnect the two members. Ends of at least one of the members have a special configuration to hold the other member in the desired interconnected position. When the hoop is twirled for jumping, sliding is prevented. On the other hand, when it is desired to slide the members for adjustment of the size of the hoop or for disassembling the hoop for convenience in packing or storing, the members may be easily moved without need of tools.

The broad objectives of the invention are accomplished by providing a jumping hoop with a rigid U-shaped, hand-held member and a flexible member joined to the hand-held member by telescoping ends. The ends are tightly fitted to prevent slipping when the hoop is twirled for jumping. The ends are sufficiently movable with respect to each other to permit adjustment of the hoop length and disassembly of the two members.

In one embodiment the ends of the rigid member are permanently deformed with dog leg or reentrant bends. The ends of the soft outer member telescope with respect to the bent ends of the rigid member, permitting the ends to be relatively moved, while preventing their movement during twirling. The rigid member may be formed as a solid rod or as a tube. The soft member may slide exteriorly on the ends of the rigid member or may slide within the rigid member when the latter is tubular.

In a preferred form of the invention, the outer U-shaped member is constructed of a light flexible tube. That construction prevents discomfort upon striking the legs of the user in practice.

In one form of the invention, the distal sections of one member are formed as a tube having a segmental opening near ends of the tube. An elastic band which may be an O-ring surrounds the solid segment of the tube and extends into the opening. The other member may be a rod or tube which has rigid or deformable walls. Ends of the second member are placed within the ends of the first member, so that the bands on the first member contact the surfaces of the second member. As the members are moved longitudinally, portions of the bands are drawn under the first tube between the first and second members, wedging the members.

One object of the invention is the provision of a jumping hoop having a first U-shaped hand-held member and a second outer member joined to the first member by telescoping ends of the member.

Another object of the invention is the provision of a jumping hoop constructed of two oppositely oriented U-shaped members with telescoping ends, one of the members having rigid bent ends and the other member having flexible ends deformed by the bends.

Another object of the invention is the provision of a jumping hoop having two oppositely formed U-shaped members, one of the members having cylindrical ends and the other member having ends which telescopically receive the cylindrical ends and which have segmental openings and encircling elastic bands at the openings for wedging between the cylindrical element and the tubular ends upon longitudinal relative movement.

These and other objects of the invention are apparent in the disclosure, which includes the foregoing and ongoing specification and claims and the drawings.

BRIEF DESCRIPTION OF THE DRAWINGS

FIG. 1 is a perspective view of a jumping hoop constructed according to the present invention.

FIG. 1A is a detail of a joint between two members of the hoop.

FIG. 2 is a modified embodiment of the invention.

FIG. 3 is a detail of one preferred joint means.

FIG. 4 is a detail of the joint means of FIG. 3 in which the elements have been longitudinally shifted, wedging the ring between the elements.

DETAILED DESCRIPTION OF THE DRAWINGS

In FIG. 1 a child is using a jumping hoop of the present invention by holding on to a hand held member, generally indicated by the numeral 10. The member has a cross portion 12 and leg portions 14 which terminate in distal sections 16. As shown in FIG. 1A, distal section 16 has a bend 18 which forms a joint means.

A second U-shaped member of the jumping hoop is generally indicated by the numeral 20. Member 20 may be a conventional soft plastic or rubber tube which is held in a U shape by anchoring its ends to legs 14 of first member 10. Member 20 has a cross portion 22, which forms the jumping area of the hoop and leg portions 24 having distal ends, which are held by complementary distal end 16 of member 10.

As shown in detail in FIG. 1A, bend 18 deforms distal section 26 of hoop member 20, holding section 26 on section 16 and holding the members together. Although section 26 may be pushed along section 16, the relative position of the members is held during twirling of the hoop for jumping purposes.

As shown in FIGS. 1 and 1A, the hand held member 10 is a rigid rod, for example, a metal or plastic rod.

As shown in FIG. 2, the hand-held member 30 comprises a U-shaped metal or plastic tube having open ends 32, in which ends of a soft U-shaped hose 36 are inserted. The distal sections of the rigid tube 30 squeeze corresponding distal sections of the flexible tube 36, holding the members of the hoop together during the swinging of the hoop for jumping. As in FIG. 1, the telescope sections of the members may be moved by pushing or pulling on the members to adjust the size of the hoop or to disassemble or reassemble the hoop. Particularly as shown in FIG. 1, the resistance to relative longitudinal movement of the members is constant, irrespective of the relative position of the members. The hoop shown in FIG. 1 may be shortened so that distal sections of legs 24 abut cross portion 12 of the hand-held member 10.

In FIG. 3, a different embodiment of a joint is shown. A distal end 40 of a U-shaped hand-held element has one or more segmental openings 42 in the wall of the tube. An elastic band, which is in this case an O-ring, having a dimension slightly smaller than tube end 40 or having a dimension substantially the same as the diameter of tube 40 is placed over the tube so that a part of the band fits within the segmental opening 42.

The distal end 46 of a second member with a cylindrical wall is placed within tube 40. The difference in the outer diameter of member 46 and the inner diameter of member 40 is less than the thickness of the O-ring 44, or approximately equal to the thickness of the O-ring.

As members 40 and 46 are assembled, they are axially twisted to reduce the friction between O-ring 44 and member 46 to sliding friction. Under that condition, relative axial movement of members 40 and 46 is permitted by the O-ring.

When members 40 and 46 are relatively moved in the direction shown by arrow 48 or in the opposite sense of direction without axial twisting of the members, the O-ring 44 is drawn beneath member 40, wedging members 40 and 46 against further axial movement in the same direction. The O-ring 44 is returned to its position in opening 42 by pushing the members in the reverse direction.

The members may be axially adjusted by lifting the O-ring 44 from opening 42 or by twisting the members back and forth to free the O-ring 44 from member 46 before axially sliding the member. The twisting changes the frictional force between O-ring 42 and member 46 to sliding friction, which permits axial sliding without drawing the O-ring under the surface of member 40.

The hand-held member may be constructed of a plastic or metal tube having a rigid form and the inner member may be constructed of a soft plastic tube.

Although the invention has been described with reference to a specific embodiment, modifications and variations may be made without departing from the scope of the invention, which is defined in the claims.

I claim:

1. An adjustable jumping hoop apparatus comprising a first elongated member bent in a U-shape having a cross portion and two leg portions, the leg portions terminating in a first pair of spaced elongated distal sections, a second elongated uniform tubular member bent in a complementary U-shape having a cross portion and two leg portions which terminate outwardly in a second pair of spaced elongated distal sections, the first pair of distal sections having relatively rigid joint means for connection to the second pair of distal sections, and the second pair of distal sections having flexible resilient joint means for telescopically joining the relatively rigid joint means of the first pair of distal sections, thereby holding the first and second elongated U-shaped members together in a jumping hoop of a selected size, wherein the rigid joint means comprises elongated elements and wherein the flexible joint means comprises elongated rigid tubes having segmental openings spaced from ends of the tubes and having flexible round resilient bands circumferentially surrounding the tubes at the segmental openings and extending into the segmental openings, the elongated elements of the first rigid joint means being positioned in the tubes, the bands extending through the segmental openings to engage the elements, whereby relative longitudinal movement of the first and second joint means frictionally draws portions of the bands from the segmental openings to positions between the elements and inner walls of the tubes, tightly wedging the elements in the tubes, against further relative axial movement in the same direction.

2. The jumping hoop of claim 1 wherein the elements have cylindrical outer walls.

3. The jumping hoop of claim 2 wherein the bands comprise O-rings which have substantially line contact with the cylindrical outer walls of the elements, whereby angularly twisting of the elements and the tubes creates sliding friction between the elements and the O-rings, thereby permitting relative axial movement of the tubes and members without wedging the O-rings therebetween.

4. The jumping hoop apparatus of claim 1 wherein the first elongated member is a rigid U-shaped member, and wherein the second elongated member is a flexible member held in a U-shape by joining with the first member.

5. The jumping hoop of claim 1 wherein the second elongated member is a soft tube.

* * * * *